United States Patent [19]

Bibber

[11] Patent Number: 4,564,465

[45] Date of Patent: Jan. 14, 1986

[54] CORROSION INHIBITION ADDITIVE FOR FLUID CONDITIONING

[75] Inventor: John W. Bibber, Norman, Okla.

[73] Assignee: Air Refiner, Inc., Oklahoma City, Okla.

[21] Appl. No.: 486,669

[22] Filed: Apr. 20, 1983

[51] Int. Cl.[4] ..... C23F 11/00

[52] U.S. Cl. ..... 252/389 R; 252/387; 252/390; 252/391; 428/18

[58] Field of Search ..... 252/387, 390, 389.3, 252/391; 422/18

[56] References Cited

U.S. PATENT DOCUMENTS

| | | | |
|---|---|---|---|
| 2,153,961 | 4/1939 | Lamprey | 252/72 |
| 3,335,096 | 8/1967 | Hatch | 252/387 |
| 3,887,481 | 6/1975 | Korpics | 252/390 |
| 3,941,562 | 3/1976 | Hollingshad | 252/387 |
| 3,966,623 | 6/1976 | Krug et al. | 252/391 |
| 4,105,406 | 8/1978 | Murray | 252/387 |
| 4,136,043 | 1/1979 | Davis | 252/391 |
| 4,241,014 | 12/1980 | Hirozawa et al. | 252/389.3 |
| 4,324,675 | 4/1982 | Barthold et al. | 252/390 |
| 4,382,008 | 5/1983 | Boreland et al. | 252/75 |
| 4,406,811 | 9/1983 | Christensen et al. | 252/392 |

*Primary Examiner*—Paul Lieberman
*Assistant Examiner*—W. Thompson
*Attorney, Agent, or Firm*—Robert M. Hessin

[57] ABSTRACT

A method and composition for corrosion protection of metal components of a fluid circulation system utilizing a buffered solution containing perchlorate ion and specific operative additives.

23 Claims, No Drawings

CORROSION INHIBITION ADDITIVE FOR FLUID CONDITIONING

BACKGROUND OF THE INVENTION

1. Field of the Invention

The invention relates generally to anti-corrosion fluid additives and, more particularly, but not by way of limitation, it relates to an improved form of composition for preventing corrosion to the metal parts of cooling systems and the like.

2. Description of the Prior Art

The prior art includes numerous types of anti-corrosion composition extending quite far back in the prior art. Some early approaches to radiator coolant additives included compounds which function both in an anti-corrosion and freezing point depressant manner. This teaching is exemplified by an early U.S. Pat. No. 1,405,320 which calls for an alkali metal chromate additive to an aqueous solution coolant. Later developments, as exemplified by U.S. Pat. No. 2,153,961, teach anti-corrosion protection through addition of a selected alkali metal chlorate to the various antifreeze liquids such as monohydric and polyhydric alcohols. In addition, prior inhibitors have utilized additives for specific metals such as nitrate, phosphates, sodium nitrite and related compounds. Later developments bringing environmental considerations negated use of certain additives, i.e., the potential explosivity of chlorates, the carcinogenous nature of nitrites, etc.

Further expansion of the art saw various other forms of anti-corrosive additive. U.S. Pat. No. 3,231,501 provides a composition for treatment of aqueous coolant with addition of borate salts. U.S. Pat. No. 3,639,263 utilized water-dispersable tannin along with specific sulfonate and inorganic metal salts. Thus, there has been prior teaching for a wide range of organic and inorganic materials for corrosion protection of the metal components of heating and cooling systems. Specific additives have been developed for protection of selected metals such as iron, copper, nickel, solder, etc.

SUMMARY OF THE INVENTION

The present invention relates to an improved form of anti-corrosion additive for fluids for use in such as cooling systems, the composition providing improved effective protection of all metallic or other components of a system while avoiding use of carcinogenic, potentially explosive, or materials having other damaging side effects. The composition in a preferred form consists essentially of a perchlorate salt for addition in selected concentration to a coolant liquid, and the composition may further consist of balanced addition of additional compounds directed to specific materials protection functions.

Therefore, it is an object of the present invention to provide an improved corrosion inhibition additive for cooling systems and the like.

It is also an object of the present invention to provide a corrosion inhibition additive that is more associative environmentally and exhibits least likelihood of carcinogenesis.

It is still further an object of the invention to provide an aqueous solution that provides more effective corrosion inhibition for iron and steel cooling system components as well as for the associated parts of other metals and alloys such as aluminum, copper, solder, etc.

It is another object of the invention to provide surface coating of circulation system components which extends corrosion inhibition in areas where cavitation of fluid flow may be present.

Finally, it is an object of the present invention to provide a user friendly additive composition for circulating system liquids which still provides maximum corrosion protection to the metal structural components.

Other objects and advantages of the invention will be evident from the following detailed description.

DESCRIPTION OF PREFERRED EMBODIMENTS

The present invention is directed to a corrosion and cavitation inhibition additive for use with cooling systems and the like for protecting the metal components of the system, particularly the iron and/or steel parts thereof. The additive composition may be used in any of the several coolant materials ranging from water through the various monohydric and polyhydric alcohol base liquids. In any case, the additive composition in aqueous solution serves to provide a protective coating for internal metal structures of the system, and a complete additive composition in accordance with the invention may render the system parts substantially free from all corrosion effects.

Basically, and in the presently preferred form, the primary additive to the coolant material is an alkali or alkaline earth salt of perchlorate. Most preferred is the sodium perchlorate salt, $NaClO_4.H_2O$, as added to the coolant solution in what is considered to be a wide range of concentration from on the order of 100 parts per million (ppm) up to much greater proportion. The solution is then buffered to a slight basic pH, as will be described. Generally then, addition of an aqueous solution of sodium perchlorate monohydrate, contributing sufficient perchlorate ion ($ClO_4^-$) in solution, will provide highly effective and safe corrosion protection for iron and/or steel, copper and alloys, aluminum, etc., in the cooling systems of various engines for automobiles, trucks, buses, etc.; and, anti-corrosion perchlorate additive may also find use in larger applications such as ships cooling systems, residential and industrial cooling towers, and any circulating fluid system utilizing metal components in association. Other alkali and alkaline earth perchlorate salts may be similarly employed, cost being a primary consideration.

Corrosion breakdown on the surface of iron or steel system components begins with the formation of $Fe_2O_3$ or as more commonly called, rust. This type of oxide coating exhibits an anti-protective character as it contributes continually to the corrosion process. The addition of perchlorate ion to the coolant liquid or solution causes iron or steel components in contact therewith to form a protective oxide coating. The perchlorate ion brings about a mixed oxidation state forming a surface ferrosoferric oxide ($FeO.Fe_2O_3$), hereinafter referred to as $Fe_3O_4$. This alternate oxide of iron is non-corrosive and actually builds to form a shielding protective coat when used in sufficient concentration, e.g., greater than approximately 100 parts per million (ppm). In addition, presence of the perchlorate ion indicates such protective function and has no negative effects on other metals within the cooling system such as copper, brass, solder and the like, and these components may actually be afforded a still more positive protection by other solution additives, as will be further described below.

It has also been found that addition of the perchlorate ion provides highly effective corrosion protection in cooling system interior passages or flow ways where cavitation patterns may be set up. Thus, areas within cavitation bubble areas may be out of contact with actual anti-corrosive fluid materials; however, with the present invention, protection is still provided by the $Fe_3O_4$ coating that is formed by the presence of the perchlorate ion. While severe pitting is formed on some iron and steel engine parts using prior art fluid corrosion inhibitors, especially along axes of vibration as in a cylinder liner, the perchlorate induced $Fe_3O_4$ coating maintains a full protective shield.

In order also to afford maximum protection to associated aluminum parts of the cooling system, one may utilize further addition within a wide range of concentrations of sodium silicate in hydrate form ($Na_2SiO_3.5H_2O$). Addition of the silicate ion ($SiO_3^{-2}$) in a concentration range including 460 ppm causes chemical reaction to coat the aluminum surface thereby to provide corrosion protection from circulating coolant. In addition to sodium silicate, a number of related silicate salts, meta and ortho-silicates and silicon esters may be added to provide the similar protective surface coating on aluminum structure.

Additional aluminum structure corrosion protection may be afforded by the addition of such as sodium nitrate which actively counteracts any tendency toward aluminum pitting and build-up of a fuzzy coating which tends to entrap and coagulate corrosion material that may cause localized corrosive effects over prolonged periods. Addition of the sodium nitrate or nitrate ion ($NO_3^-$) to a minimal concentration on the order of 700 ppm will function to prevent pitting and fuzz coat build-up on aluminum; however, it should be understood that there is a wide range of concentrations of nitrate ion that may be utilized.

The pH value of the aqueous solution may be kept within a desired range by addition of a selected amount of buffer material such as borax ($Na_2B_4O_7.5H_2O$ ). Thus, a relatively heavy concentration of buffer may be required to bring about desired pH value adjustment. Various other carbonates and phosphates may also be utilized for this purpose in well-known manner. A chelating agent such as sodium polyacrylate may be added in minor concentration of about 25 ppm to prevent hardness and undue coagulation of foreign materials in the cooling solution. Other chelating agents such as ethylenediaminetetraacetic acid (EDTA) or nitrilotriacetic acid (NTA) may be used in preselected effective concentration.

It may also be desirable to provide further protection for copper and brass components utilized in the cooling system. Thus, addition to the aqueous solution of commercial grade tolytriazole in a minimal concentration of about 200 ppm will afford such copper and brass corrosion protection. Solder connections and joints may be protected with addition of such as 2-mercaptobenzothiazole or any of the several alkali metal salts thereof. Addition of the solder protective agent to the desired concentration functions to effect formation of a protective film over the solder surface thereby to shield from contact with circulating coolant and any corrosive materials.

EXAMPLE A

Primary testing has been carried out for iron, steel, aluminum, brass and copper specimens in presence of a solution including the perchlorate ion. Thus, sodium perchlorate monohydrate in water solution in concentration of at least 100 ppm, with addition of sufficient borax to buffer the pH to a slight basic value of about 9, exhibits effective and rapid formation of the $Fe_3O_4$ film on the iron and steel specimens thereby to provide corrosion protection. No deleterious effects were noted for the brass and copper specimens while the aluminum specimen showed slight pitting. Aluminum corrosion can be effectively combatted with further additives (silicates, nitrates) as set forth above.

EXAMPLE B

Basic corrosion protection of key system components was provided by mixing an aqueous coolant solution including perchlorate and nitrate. Thus, sodium perchlorate monohydrate contributes $ClO_4^-$ ion in proportion of approximately 450 ppm, with sodium nitrate adding $NO_3^-$ presence to approximately 700 ppm, thereby to inhibit corrosion of iron, steel, aluminum and solder in highly effective manner, as was noted in testing. Minimal corrosion loss was noted for brass and copper. Testing of the above low corrosion coolant was carried out in accordance with the required procedures of "Corrosion Test For Engine Coolants in Glassware" as set forth at pages 215–223 of *ASTM American National Standards*—1982, ANSI/ASTM D1384 (Reapproved 1975). Weight loss due to corrosion was minimal showing excellent protection for the component structural metal specimens.

EXAMPLE C

An aqueous solution of sodium perchlorate monohydrate and sodium nitrate, e.g. $ClO_4^-$ at 450 ppm and $NO_3^-$ at 720 ppm, was tested in accordance with the standard procedures for "Simulated Service Corrosion Testing of Engine Coolants" as set forth at pages 357–365 of *ASTM American National Standards*—1982, ASTM D2570-73. This test, simulating engine conditions and carried out at 190° Fahrenheit temperature, also exhibits to good degree the effectiveness of the perchlorate additive as a corrosion inhibitor in cooling systems, particularly with higher temperature coolants. Weight tally of metal specimens after 332 hours of continuous test indicate extremely good corrosion inhibition with zero weight loss for steel and losses on the order of 0.0005% to 0.001% for copper, brass and cast iron. Losses for aluminum and solder are also negligible and within acceptable limits; however, these metals may be still further protected with special additives as above described.

While the above recitation of additive concentrations are recited relatively precisely as was the case in specific tests, it should be understood that the active additive concentrations may vary within a wide range while still yielding effective anti-corrosion interaction. Thus, any of the perchlorate, silicate, nitrate, borate and other additives may be varied within wide limits of dry measure in constituting the selected additive composition.

EXAMPLE D

A complete form of corrosion inhibition solution which has proven to function to very good advantage may be formed with a specified measure as follows:

| | |
|---|---|
| sodium perchlorate monohydrate | 0.635 grams per liter |
| sodium silicate | 1.300 grams per liter |

-continued

| | |
|---|---|
| sodium nitrate | 1.000 grams per liter |
| sodium borate (borax) | 4.5 grams per liter |
| sodium polyacrylate | 0.025 grams per liter |
| tolytriazole | 0.200 grams per liter |
| 2-mercaptobenzothiazole | 0.500 grams per liter |
| TOTAL | 8.160 grams per liter |

The above composition provides a complete corrosion inhibition additive for protection of iron, steel, aluminum, copper, brass and solder while also providing buffering and chelating adjustment to the solution. Thus, while the primary perchlorate additive functions to protect the metal components, particularly iron and steel, the remaining additives selectively function to fulfill the complete corrosion protection process. Final selection of ingredients for a coolant solution may be dictated by presence or exclusion of certain metallic materials within the cooling system and in contact with the solution, and such adjustment may be varied in accordance with the exigencies of each particular cooling application. The additive may be prepared in dry measure for addition to water or other standard coolant materials, or liquid coolant solution may be prepared in entirety.

Another mode of introducing the perchlorate ion into the coolant solution is by use of a carrier such as anion ion exchange resin. For example, ion exchange resin such as A1O1-D or A102-D, commercially available from Diamond Shamrock Co., may be processed to carry perchlorate ion for subsequent disposition directly into the coolant fluid. In this case the source may be perchloric acid as passed through a column of the ion exchange resin, and the charged resin may then be washed by strong basic solution such as NaOH, KOH into the coolant fluid at desired concentration. Again, the coolant should be buffered to adjust pH to slight basic.

It may also be desirable in certain coolant or circulating fluid applications to effect hardness control of the fluid. In this case, a commercially available cation-ion exchange resin, e.g. R-190 IONAC from Sybron Corp. of Birmingham, N.J., may be added to the solution for aiding in removal of calcium, magnesium, etc.

Changes may be made in the composition and concentration of materials as heretofore set forth in the specification; it being understood that changes may be made in the specific examples disclosed without departing from the spirit and scope of the invention as defined in the following claims.

What is claimed is:

1. A corrosion inhibitor for addition to the cooling fluid in a fluid circulating cooling system, comprising:

an additive of a soluble aikali metal salt of perchlorate in solution with said fluid in a concentration in the range of 100 to 1000 ppm and forming ions of perchlorate.

2. A corrosion inhibitor as set forth in claim 1 wherein:

said additive is sodium perchlorate monohydrate in concentration of at least 100 ppm.

3. A corrosion inhibitor as set forth in claim 1 which further includes:

a second additive placing nitrate ion in solution in concentration of at least 100 ppm.

4. A corrosion inhibitor as set forth in claim 3 wherein: said second additive is sodium nitrate.

5. A corrosion inhibitor as set forth in claim 3 which further includes:

a third additive placing silicate ion in solution in concentration of at least 200 ppm.

6. A corrosion inhibitor as set forth in claim 1 which further includes:

a second additive placing silicate ion in solution in concentration of at least 200 ppm.

7. A corrosion inhibitor as set forth in claim 5 which further includes:

at least one chelating agent additive.

8. A corrosion inhibitor as set forth in claim 5 which further includes:

a buffering agent adjusting pH value of the additive solution to a basic value in the range of 7–11.

9. A corrosion inhibitor as set forth in claim 5 which further includes:

an additive of tolytriazole in concentration within a range of 100 ppm to 400 ppm.

10. A corrosion inhibitor as set forth in claim 5 which further includes:

an additive of benzotriazole in concentration within a range of 100 ppm to 400 ppm.

11. A corrosion inhibitor as set forth in claim 5 which further includes:

an additive of 2-mercaptobenzothiazole in concentration within a range of 100 ppm to 1000 ppm.

12. A corrosion inhibitor as set forth in claim 5 which further includes:

a cation-ion exchange resin in concentration to control solution hardness.

13. A method of inhibiting the corrosion of system structural metals in cooling systems utilizing circulating fluid coolant comprising:

adding perchlorate ion in solution with said fluid coolant at a concentration in the range from 100 ppm to 1000 ppm.

14. A method as set forth in claim 13 further includes:

adding nitrate ion in solution with said fluid coolant at a concentration in the range from 200 ppm to 2000 ppm.

15. A method as set forth in claim 13 which further includes:

adding silicate ion in solution with said fluid coolant at a concentration in the range from 300 ppm to 600 ppm.

16. A method as set forth in claim 14 further includes:

adding silicate ion in solution with said fluid coolant at a concentration in the range from 300 ppm to 600 ppm.

17. An aqueous solution for use as a non-corroding circulating fluid in a fluid system which may include any of iron, steel, aluminum, copper, brass, solder and other metal structural components, comprising:

water; and a perchlorate salt of an alkali metal contributing perchlorate ions in an amount within the range of 0.10 grams to 5 grams in solution per each liter amount of water.

18. An aqueous solution as set forth in claim 17 which further comprises:

nitrate salt of the group including alkali and alkaline earth metals in an amount within the range of 0.5 grams to 10 grams in solution per each liter amount of water.

19. An aqueous solution as set forth in claim 17 which further comprises:

an alkali metal silicate salt in an amount within the range of 0.5 grams to 5 grams in solution per each liter amount of water.

20. An aqueous solution for use as a non-corroding circulating fluid in a fluid system which may include any of iron, steel, aluminum, copper, brass, solder, and other metal structural components, comprising:

water; and an anion-ion exchange resin contributing perchlorate ions in an amount within the range of 0.10 grams to 10 grams in solution per each liter amount of water.

21. A method of effecting corrosion protection to iron and steel system components that come in contact with the fluid in a fluid circulation system, comprising:

adding to the fluid an amount of perchlorate ion sufficient to effect formation of a protective mixed oxide coating of $FeO.Fe_2O_3$ on said system components.

22. A method as set forth in claim 21 wherein said step of adding comprises:

placing in solution with said fluid an effective amount of a perchlorate salt as selected from the alkali and akaline-earth metal salts thereof.

23. A method as set forth in claim 21 wherein said step of adding comprises:

placing in said fluid a selected amount of an anion-ion exchange resin bearing said perchlorate ion in attractive association.

* * * * *